US006768276B2

(12) United States Patent
Yen

(10) Patent No.: US 6,768,276 B2
(45) Date of Patent: Jul. 27, 2004

(54) SET-UP DEVICE FOR ON-LINE PHOTO-ELECTRIC LOCALIZATION

(75) Inventor: George Yen, Taipei (TW)

(73) Assignee: Star-Reach Corporation, Taipei (TW)

( * ) Notice: Subject to any disclaimer, the term of this patent is extended or adjusted under 35 U.S.C. 154(b) by 0 days.

(21) Appl. No.: 10/216,292

(22) Filed: Aug. 12, 2002

(65) Prior Publication Data

US 2003/0227267 A1 Dec. 11, 2003

(30) Foreign Application Priority Data

Jun. 10, 2002 (TW) ..... 091208542

(51) Int. Cl.[7] ..... H05B 41/00

(52) U.S. Cl. ..... 315/317; 315/318; 315/361; 315/362; 370/349; 370/379

(58) Field of Search ..... 370/349, 389, 370/382, 379; 712/200, 300; 315/312, 317, 318, 324, 361, 362

(56) References Cited

U.S. PATENT DOCUMENTS 5,727,110 A * 3/1998 Smith et al. ..... 385/147
5,769,527 A * 6/1998 Taylor et al. ..... 362/85
5,983,280 A * 11/1999 Hunt ..... 709/236
6,166,496 A * 12/2000 Lys et al. ..... 315/316

* cited by examiner

*Primary Examiner*—Haissa Philogene
(74) *Attorney, Agent, or Firm*—Troxell Law Office PLLC

(57) ABSTRACT

The present invention provides a system device, which sets-up IDs for plural devices, On-Line, especially for illuminating equipments connected with standard DMX signals, mainly by logging related data with non-volatile memory elements (NOV-RAM, EEPROM, and FLASH etc.), and separately depositing, On-Line, the operation data needed by the entire system, into designated individual devices with specifically arranged communication protocols and procedures, and enabling said device operating in standard DMX signal system.

1 Claim, 4 Drawing Sheets

SET-UP DEVICE FOR ON-LINE PHOTO-ELECTRIC LOCALIZATION

BACKGROUND OF THE INVENTION

The present invention, DMX-512 (and DMX-1990) signal, is a standard communication format in the area of control of stage and illumination, the main control equipments and controlled devices of illumination and stage devices of the whole world use said standard design without exception. Therefore all the master control equipments and controlled devices can communicate in a same language, and achieved is the prosperous development of that area.

DMX signal is in a uni-directional repetitive communication protocol, of which the substantive interface is RS-485, all the devices are connected in parallel to said signal line, and obtain the control data respectively following a definite rule. Said protocol comprises a group of synchronized signals and 512 (or more) device-controlling codes. The synchronized signals comprise a low logic level (Logic "0") larger than 44 us, followed by a high logic level (Logic "1") larger than 44 us and an initial data string with a value of zero (refer to the standard documents of DMX organization for details). 512 device-controlling codes are 512 standard non-synchronized data in series, with a data rate of 250 KB/S.

Since all the DMX devices are connected to a group of DMX signal lines simultaneously, each controlled device needs an ID setter to determine which group of signal to obtain from a series of signals for use. And master control device has to rely on the IDs set-up by various devices on all the lines, to determine the arranged sequence of respective control signal.

In a standard DMX signal series as shown in FIG. 9, a synchronized signal is consisted of a low level (0) cycle (901) larger than 44 us, a high level (1) cycle (902) larger than 44 us, and a data string (903) with a value of "0", followed by 512 or more data strings (904+1~904+512), so to be a signal cycle, and repeated endlessly.

Conventional IDs on controlled device of DMX are set-up at installation according to needs, said operation in the stage system with quick install-dismount is necessary, for it is not easy to install each device at the designated position in the install-dismount process, so the ID on it has to be changed easily any time. Although, if said device is installed at places not easy to access (such as: the exterior wall of a building), or places where its install-dismount is not easy (such as the under-ground, or amid-a-pool), this type of operation manner, adjusting IDs any time, would not be appropriate, because the already set-up IDs may be erroneous, the set-up positions may be inter-changed, or may be due to erroneous original design that all the IDs have to be mended, and devices installed at, such as: the above-mentioned exterior wall, under-ground, or in-the-water, generally are not easy to install-dismount, more-over the water-proof design of the device may loose its water-proof function due to the insufficient quality of installing personnel or equipment and due to repeated install-dismount, the stability of the system will be seriously affected.

Surely, feasible systems to replace DMX signal system may be developed with the art of the digital technology today, such as: net-work (NET) practiced through years is very good a choice, still, to render the world's millions kinds of DMX equipments changed into net-work over-night might be an impossible task, and will substantially increase the cost of all the devices and cable system, for this solely, net-work (NET) system is not an ideal solution.

Our company has been devoted in research and manufacture of DMX illumination equipments for more than 5 years, and is well aware of the great affects of this shortcoming on the quality of its engineering and costs, so made the investment and developed the present device. At the installation of the present device of the system, the individual IDs of the devices need not be considered about first, while the installation of the system is completed, the individual device then is set-up, On-Line, with control system, and at the same time the ID of each device is adjusted according to need any time. The greatest feature is the entire system can work under the standard DMX signal system.

In consideration of the need for water proofing, after manufactured and tested in the factory, until installation is completed and use is begun, no damage to any of the water-proof design (for example: opening up of the device for any adjustment) is hoped for from the start, so a non-volatile memory element (such as: EEPROM/FLASH MEMORY) is designed on every device to log the data (such as: IDs) needed by the operation of said device, then in coordination with microprocessor or application specific integrated circuit (ASIC), the data needed for various operations are loaded-in to said non-volatile memory element through signal lines. When the system is officially in operation, the data loaded- in the non-volatile memory element is out-putting for the operation of the device.

In order that the device still to be set-up for an ID to be distinguished in the same signal line, so a set of IP (distinguishable from an ID of DMX, and similar to an IP on the net-work card) is deposited in advance in every device. This IP is deposited while being produced in factory, and unless necessary will not be modified. The method to deposit this set of IP has to be depositing Off-Line, after production of device is completed with specifically produced equipment, as well as deposited into memory in advance, before the elements are assembled on circuit board.

SUMMARY OF THE INVENTION

The present invention provides a system device, which sets-up IDs of plural devices, On-Line, especially referring to illuminating equipments connected with standard DMX signals, mainly by logging related data with non-volatile memory elements (NOV-RAM, EEPROM, and FLASH etc.), and separately depositing, On-Line, the operation data needed by the entire system, into designated individual devices with specifically arranged communication protocols and procedures, and enabling said device working in standard DMX signal system.

DETAILED DESCRIPTION OF THE EMBODIMENT AND STRUCTURE

Figure 1:
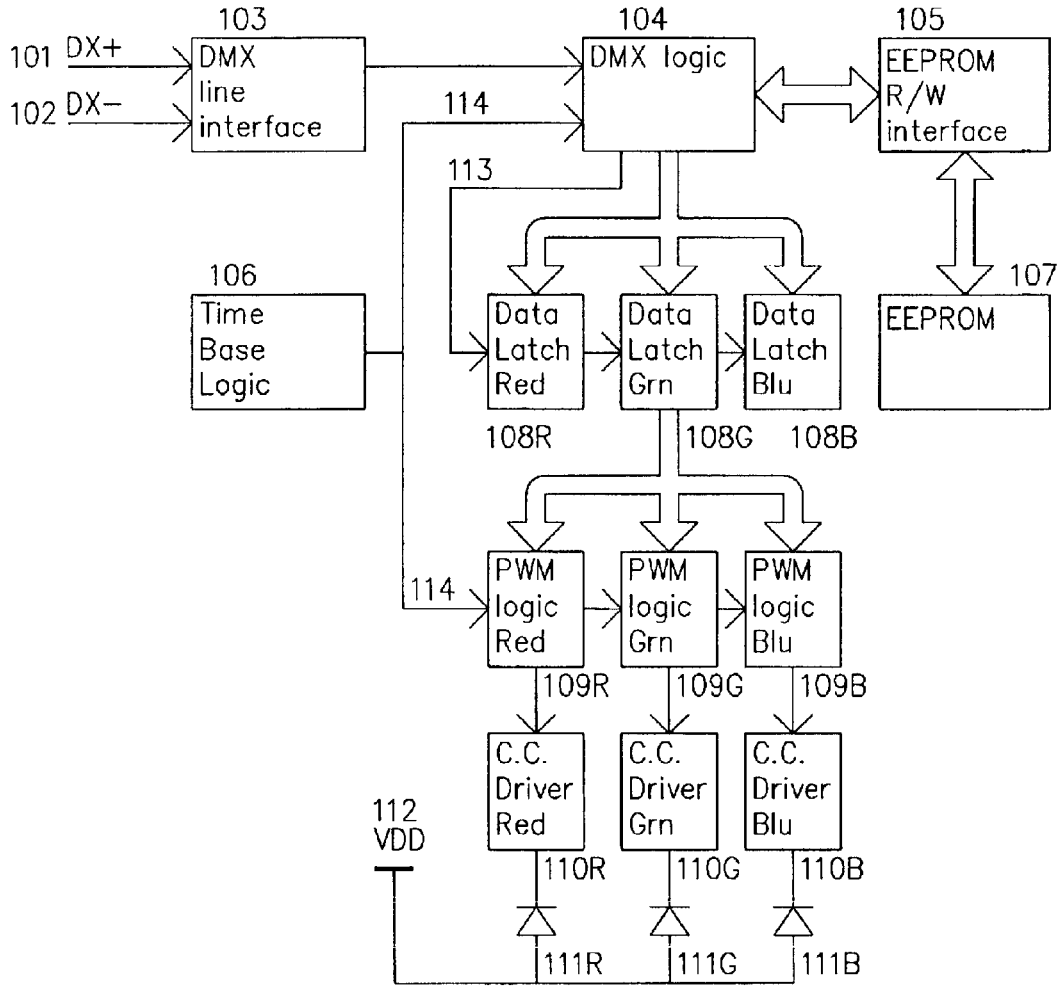
FIG. 1 is the basic block drawing of the present invention.
Figure 2:
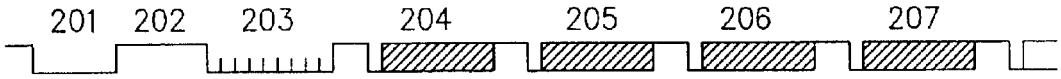
Prior Art Fig. 2
FIG. 2 is the diagram of the conventional standard DMX signal protocol.

As shown in FIG. 1 the basic block drawing of the present invention, a set of DMX signal interface (103) converts the standard RS-485 signal DX+ (101) and DX− (102) into digital signal, and pass it over to be processed by DMX logic element (104). When the DMX logic element (104) receives the load-in/out-put command, the IP/ID is loaded-in or out-put from EEPROM (107) by the EEPROM load-in/out-put element. The operation reference of time-line of the system is generated by the reference of time-line generating element (106) for the entire installation. The other part of FIG. 1 is a circuit with color-changing lamp-lights, for the description of the system here: after the DMX logic element (104) has received the normal DMX signal, the received data are transmitted to 3 Signal Latches (108R/108G/108B) for latching, and delivered to 3 PWM control elements (109R/109G/109B) to generate the correspondent duty cycles according to latched data, and, delivered to 3 Current Drivers (110R/110G/110B) to drive 3 sets of LEDs (111R/111G/111B) to generate all kinds of color-changing lights.

DMX logic element (104) can be assembled from Application Specific Integrated Circuit (ASIC); also can be preceded by a set of speedy microprocessor (MPU). Its operation flow chart is described in FIG. 7, ordinary engineers can complete the designing of functions of this kind according to this description, and EEPROM load-in/out-put logic element (105) is a common sense, and is not dealt with here.

FIG. 2 to FIG. 6 are protocols of standard DMX signal (FIG. 2), and signal protocol that has to be added in the present device (FIG. 3 to FIG. 6). The method used in the present device is mainly modifying the synchronized signal of the standard DMX signal protocol, by changing the data string with a value of "0", which, in the 3rd part (203) of the synchronized signal in the standard DMX signal (FIG. 2), into other values, and by providing related functions, this modification can make other kinds of DMX signal receiving equipments automatically avoid the set commands of the present device, also that the present device can be connected to other standard DMX systems to operate after set-up.

Figure 3:
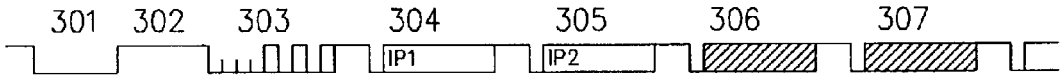
FIG. 3 is the diagram of the added signal protocol needed by the device of the present invention.

FIG. 3 is an IP load-in protocol, in which the 3rd part of the DMX synchronized signal (FIG. 2) is changed into 0A0H, and the IP value of said device is in-put into 2 following data strings. The set-up of IPs must be proceeded alone Off-Line. An IP value is one value only and is never changed. Since DMX illumination system is a closed and very professional zed a system, more-over a uni-directional signal-transmitting system, the master control equipment can not use the corresponding signal in distinguishing the IPs of individual devices, too many IPs readily make the operator unable to distinguish individual devices easily. There fore designing 2 BYTEs to distinguish 65,536 devices are a reasonable design.

Figure 4:
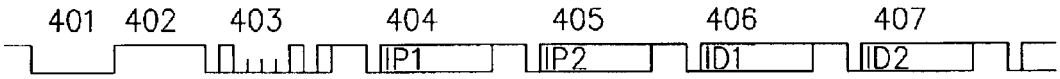
FIG. 4 is the added signal protocol needed by the device of the present invention.

FIG. 4 is a ID loading protocol, in which the 3rd part (403) of the DMX synchronized signal is changed into 0A1H, and the IP value of said device is in-put into 2 following data strings, and the ID value to be set-up is in-put into the 3rd and 4th data strings. When all the on-line devices receive said string of signal, the IP value in the device is compared with the IP values (404, 405) in the signal string, if said values are equal, the following ID values (406, 407) are in-put into the EEPROM of the device. Standard DMX system needs a 9-BIT IDs, in 2 of the BYTEs there are still 7 more BITS for installing other set-ups. Certainly if there are more functions to be set-up in the system, more data strings can be added-in after the ID values (406, 407). Although, this specification describes the basic concepts only. Because the IDs can be set-up or modified according to needs after the system is installed, so the difficulty of the installation is greatly lowered. Also, all the devices are completed with necessary water-proof treatments and tests in the factory, there is no need to install-dismount for adjustment during installation procedure, so the entire system can be assured to be in the best condition.

Figure 5:
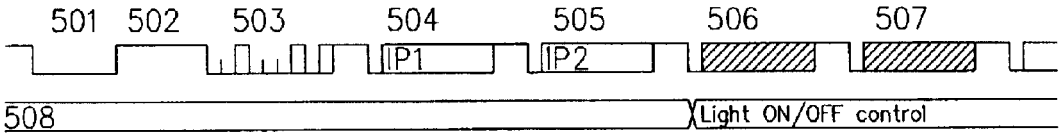
FIG. 5 is the added signal protocol needed by the device of the present invention.
Figure 6:
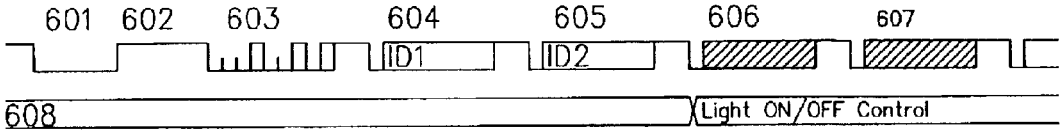
FIG. 6 is the added signal protocol needed by the device of the present invention.

FIG. 5 and FIG. 6 are the signal protocols added for increasing the ease of use of the system in the present invention. Because the DMX signal system is a uni-directional transmission system, all the controlled devices On-Line can receive signals passively, but can not respond about the condition of their-self, so after the installation of the system is completed, unless the IP of each device was logged in advance, or else it is difficult for the operator to guess the IP of each device. Therefore, IP searching command (FIG. 5) was added in the present device, in which the 3rd part (503) of the DMX synchronized signal was changed into 0A2H, and when said command is received in the present device with IP values (504, 505) identical with IP values in the device, the lights (508) of said device will be lit. Therefore the operator can be assured with the IP of the device according this, and further, can set-up the ID of the device correctly. In addition, the lighting-up of the lights (with load increased) can be detected by the power supplying system, and an automatic IP-detecting system be designed very easily. If this IP-detection is sent with a computer software, each cycle (a set of synchronized signal plus 2 IP data strings) takes about 200 us in average, and 5,000 cycles can be sent in a second, 65,536 IPs can be scanned in 15 seconds. And this operation is very fast.

The signal protocol in FIG. 6 is identical with that in FIG. 5, except the 3rd part (603) of the DMX synchronized signal is changed into 0A4H, and the DMX device respond to ID values only. The object of adding this protocol is when the set-up of IDs is completed with the entire system, the correctness of all the set-ups can be confirmed with this protocol.

Figure 7:
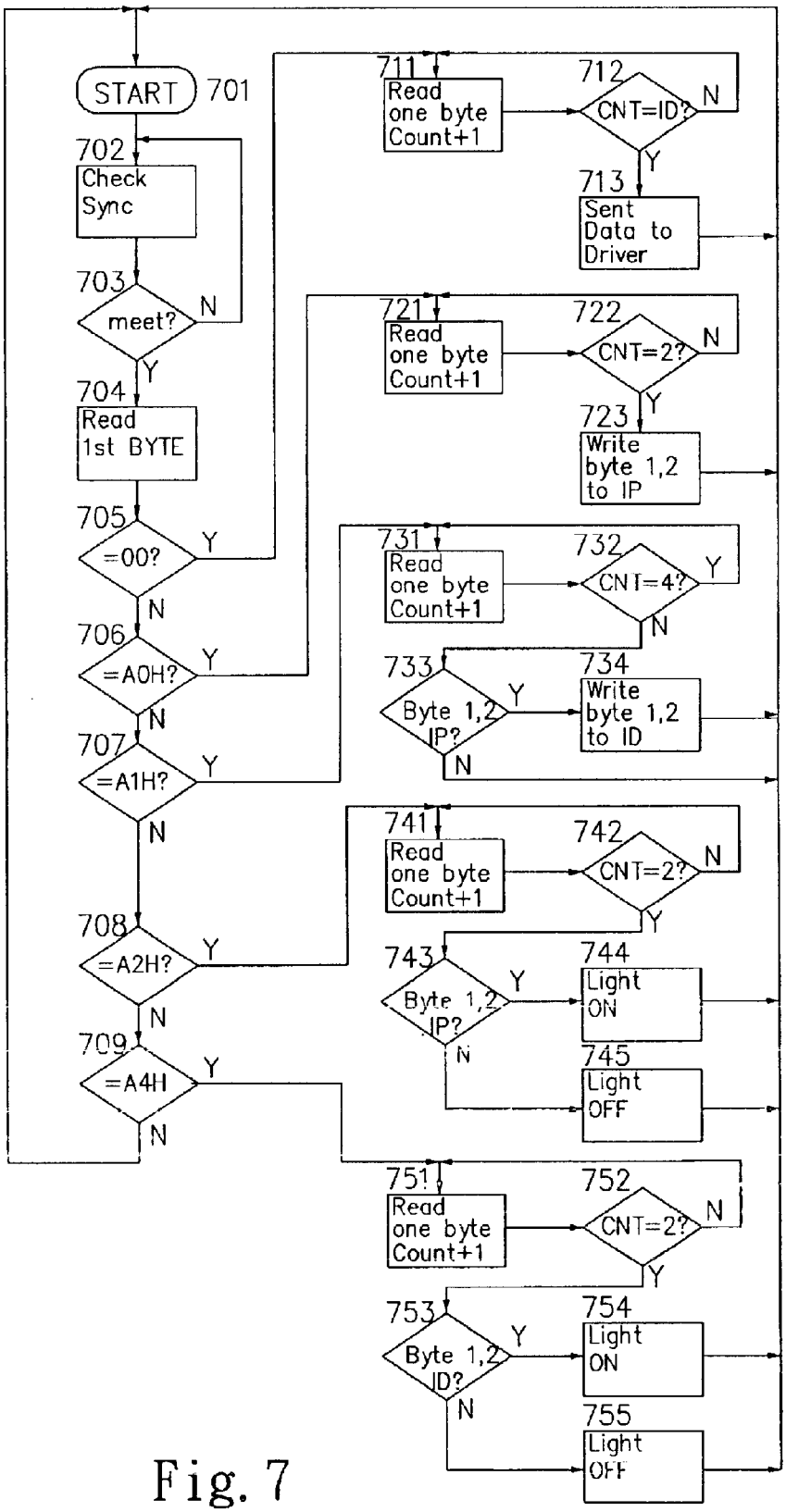
FIG. 7 is the block diagram of the operation flow of the present invention.

As shown in FIG. 7 the operation flow chart of the present device, at the start of the operation flow, the DMX synchronized signal (702) is detected by the activating element (701). When the synchronized signal is still un-assured (the N of 703), the operation flow goes back to the point of detection of DMX synchronized signal (702), and when synchronized signal is detected (the Y of 703), the system further reads the 1st data string (704), and after the data string is read, the value of said data string is judged, if the 1st data string:

- equals to "00" (the Y of 705), the system starts counting the received data strings (711), when the data string read by the counting equals to the ID value, the Y system of the distinguishing latch (712) sends the read data to a driver to drive the related equipment (713), and goes back to the starting point (701);
- equals to "0A0H" (the Y of 707), the system reads the next 2 data strings (721, 722), and loads the 2 strings into EEPROM (723) as an IP;
- equals to "0A1H" (the Y of 707), the system reads the next 4 data strings (731, 732), and simultaneously compares the values of the 1st and 2nd data strings and the IP (733), if the same (the Y of 733), loads-in the 3rd and 4th data strings into EEPROM (734) as an ID;
- equals to "0A2H" (the Y of 708), the system reads the next 2 data strings (741, 742), and compares the values of the 1st and the 2nd data strings and the IP (743), if the same (the Y of 743), lights up the light (744), and if different (the N of 743), turns off the light (745);
- equals to "0A4H" (the Y OF 709), the system reads the next 2 data strings (751, 752), and compares the ID values of the 1st and 2nd data strings and the ID (753), if the same (the Y of 753), lights up the light (754), and if different (the N of 753), turns off the light (755).

Figure 8:
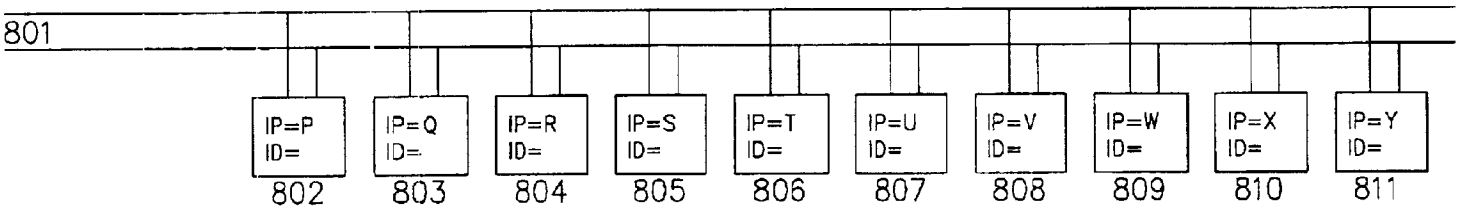
FIG. 8 is a diagram of the operating principle of the system of the present invention.
Figure 9:
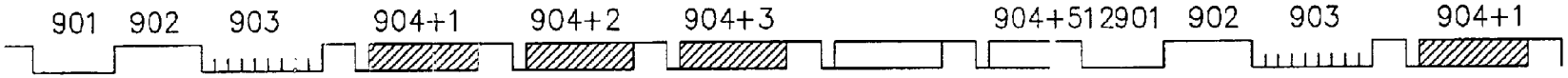
Prior Art Fig. 9
FIG. 9 is a diagram of a known DMX signal series.

When the installation of all the devices is completed, all the IDs can be loaded-in into each device according to the IP of each device, corresponding to its due ID, On-Line, and likewise when the ID needs to be changed. The operation principle of this system is as shown in FIG. 8: plural sets of DMX devices (802~811) connected on one DMX signal line (801), with each DMX device (802~811) deposited into with a set of IP (P~Y in the drawing) in advance. When the installation of the system is completed, then the working IDs are loaded-in into each DMX device (802~811), from the DMX signal line (801), with specific communication protocol, therefore, all the DMX devices on (801) line can work normally.

Accordingly, the present invention provides system devices for setting-up IDs for plural devices On-Line, and uses non-volatile memory elements (NOV-RAM, EEPROM, FLASH, etc.) in logging related data, and separately deposits, On-Line, the operation data needed by the entire system, into designated individual devices with specifically arranged communication protocols and procedures, and enables said device working in standard DMX signal system.

What the invention claim is:

1. A set-up device for on-Line photo-electric localization includes a DMX-receiving part, a logic element for special DMX commands, a non-volatile memory element (NOV-RAM, EEPROM, and FLASH etc.), and a logic part for load-in/out-put for non-volatile memory elements, this device is characterized with:

the device for setting-up for On-Line photo-electric localization which operates in a standard DMX signal system, with depositing in each DMX device a set of IP into the non-volatile memory element of said DMX device in advance, when plural sets of DMX devices of a same model are installed on one DMX signal system, the ID localization data needed by the operation of each DMX device being deposited into each designated ID, through specially arranged commands (non-standard DMX commands, but compatible with the system of standard DMX signal), in order that each said DMX device operates normally in the standard DMX signal system.

* * * * *